US005762286A

United States Patent [19]

Schutz

[11] Patent Number: 5,762,286

[45] Date of Patent: Jun. 9, 1998

[54] DISPENSER FOR A PLURALITY OF CENTER PULL TOWELS INCORPORATING TOWEL TRANSFER MECHANISM

[75] Inventor: Rudolph W. Schutz, Ft. Bragg, Calif.

[73] Assignee: Perrin Manufacturing Company, City of Industry, Calif.

[21] Appl. No.: 902,734

[22] Filed: Jul. 30, 1997

[51] Int. Cl.[6] ..... B65H 23/06

[52] U.S. Cl. ..... 242/593; 242/560

[58] Field of Search ..... 242/593, 560, 242/560.1

[56] References Cited

U.S. PATENT DOCUMENTS 3,294,329 12/1966 Tucker et al. ..... 242/597.8
3,381,909 5/1968 Tucker et al. ..... 242/597.8
5,219,126 6/1993 Schutz .
5,265,816 11/1993 Collins ..... 242/560
5,645,244 7/1997 Moody ..... 242/560

*Primary Examiner*—John P. Darling
*Attorney, Agent, or Firm*—Thomas R. Lampe

[57] ABSTRACT

Dispenser apparatus for sequentially dispensing sheet material from two center pull coreless rolls of sheet material disposed side-by-side includes a support for supporting the coreless rolls on end and two dispenser elements, each of which receives the lead end from a roll. The dispenser elements are movable so that the lead ends of the rolls are alternately presented for manual access by a consumer. An arrangement is provided to provide for automatic transfer between rolls when one roll is depleted.

16 Claims, 8 Drawing Sheets

DISPENSER FOR A PLURALITY OF CENTER PULL TOWELS INCORPORATING TOWEL TRANSFER MECHANISM

TECHNICAL FIELD

This invention relates to dispenser apparatus for sequentially dispensing sheet material from a plurality of center pull coreleses rolls. The teachings of the invention are particularly applicable to dispensing of paper toweling from coreless paper towel rolls.

BACKGROUND OF THE INVENTION

Dispensers utilized to dispense paper toweling from coreless rolls thereof are known in the art. Such rolls include a lead end and a tail end. In center pull dispenser constructions the lead end of the toweling is pulled from the center of the roll through an opening in the dispenser, typically an opening in the dispenser bottom. A nozzle is disposed at the dispenser bottom defining a passageway through which the toweling is pulled and which provides for or facilitates removal of individual sheets from the toweling by the consumer.

While many arrangements are known in the prior art for effecting automatic transfer between depleted rolls of paper toweling or tissue and full rolls, such transfer mechanisms are normally employed to effect automatic transfer between rolls having cores, i.e., paper towel and toilet tissue rolls of conventional type. Such mechanisms are often characterized by their relative complexity and high expense and do not readily lend themselves to use with coreless center pull rolls.

U.S. Pat. No. 5,219,126, issued Jun. 15, 1993, discloses a dispenser for automatically initiating dispensing from a reserve coreless center pull paper roll in response to depletion of a primary coreless center pull paper roll. However, with respect to such prior art dispenser, the coreless rolls are positioned such that one of the rolls is located over the other of the rolls. Both rolls are dispensed through a single truncated cone-like dispenser element projecting downwardly from the bottom wall of the dispenser housing. The lead end of the reserve roll is connected to the tail end of the primary roll to provide for automatic transfer. Use of a single dispenser element results in a high rate of wear. Furthermore, the over and under configuration of the rolls complicates servicing of the dispenser.

As will be seen in greater detail below, in contrast to the approach disclosed in U.S. Pat. No. 5,219,126, the apparatus of the present invention dispenses from two center pull coreless rolls disposed side-by-side with each roll being associated with its own dispenser element or nozzle. The invention is characterized by its relative simplicity and low cost and by its ease and reliability of use. An attendant can readily and quickly service the dispenser apparatus to replace a roll which has been depleted with a full roll, the latter then serving as the reserve roll. Since two nozzles are employed, operative longevity of the dispenser apparatus is prolonged.

DISCLOSURE OF INVENTION

The present invention relates to a dispenser apparatus for sequentially dispensing sheet material from two center pull coreless rolls of sheet material disposed side-by-side, each coreless roll including a lead end and a tail end.

The dispenser apparatus includes support means for supporting a first coreless roll of sheet material on end at a first location and for supporting a second coreless roll of sheet material on end at a second location with the first and second coreless rolls of sheet material disposed side-by-side.

A first dispenser element is located adjacent to the support means and defines a passageway for receiving the lead end of a first coreless roll of sheet material supported on and by the support means at the first location.

A second dispenser element is located adjacent to the support means and defines a passageway for receiving the lead end of a second coreless roll of sheet material supported on end by said support means at the second location. The second dispenser element is movably mounted relative to the support means and movable away from the support means to a dispensing position wherein the lead end of the second coreless roll of sheet material is presented for manual grasping by an individual and pulling of sheet material by the individual from the second coreless roll of sheet material through the passageway of the second dispenser element.

The dispenser apparatus also includes dispenser element moving means for moving the second dispenser element to dispensing position responsive to depletion of the first coreless roll of sheet material.

Other features, advantages, and objects of the present invention will become apparent with reference to the following description and accompanying drawings.

MODES FOR CARRYING OUT THE INVENTION

Figure 1A:
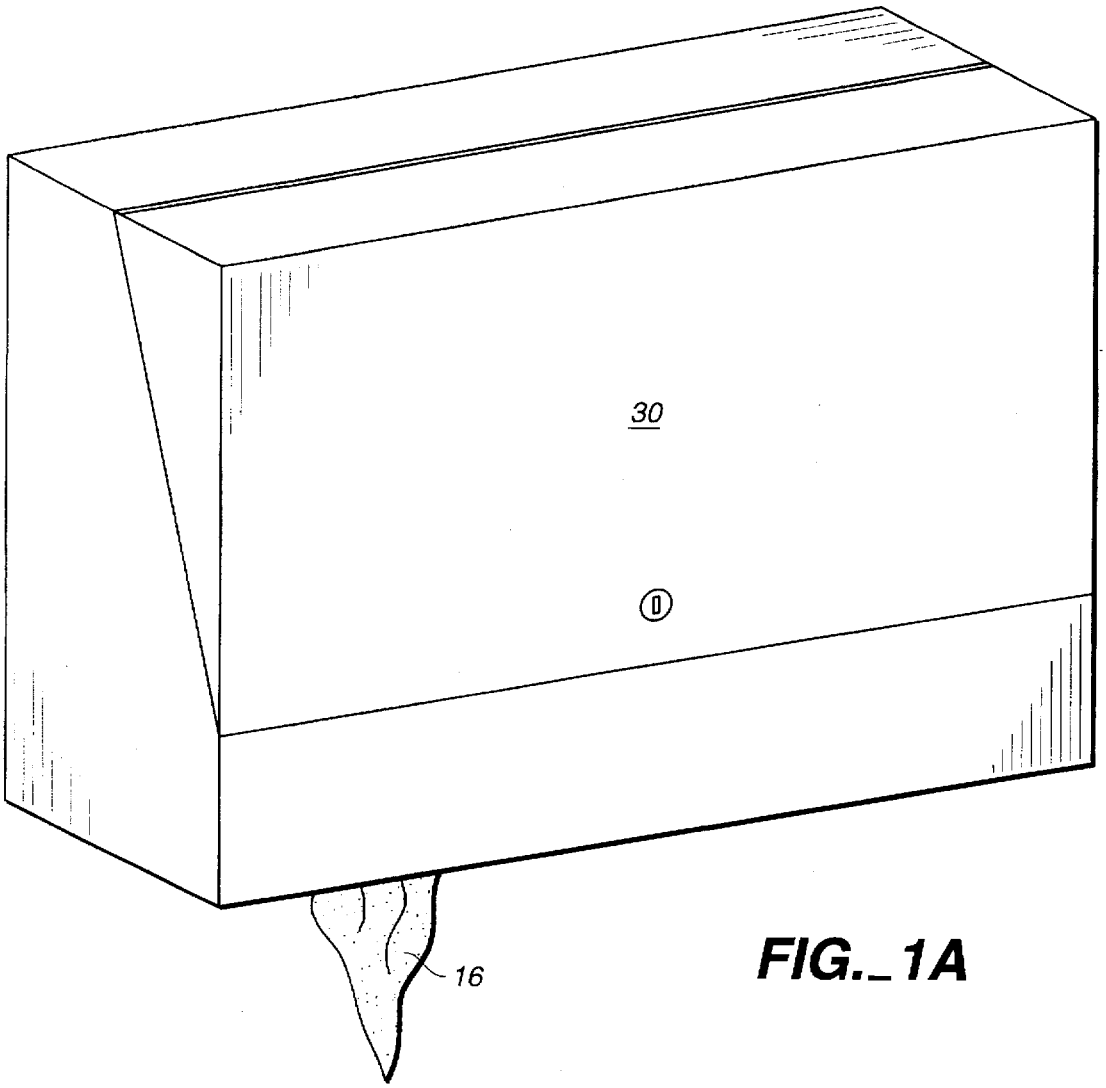
FIG. 1A is a perspective view of the housing of a dispenser constructed in accordance with the present invention.
Figure 3:
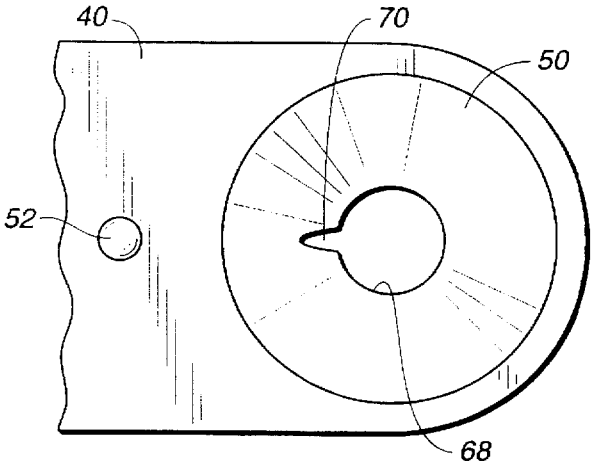
FIG. 3 is an enlarged top view of a nozzle employed in the apparatus and a segment of related structure.
Figure 1B:
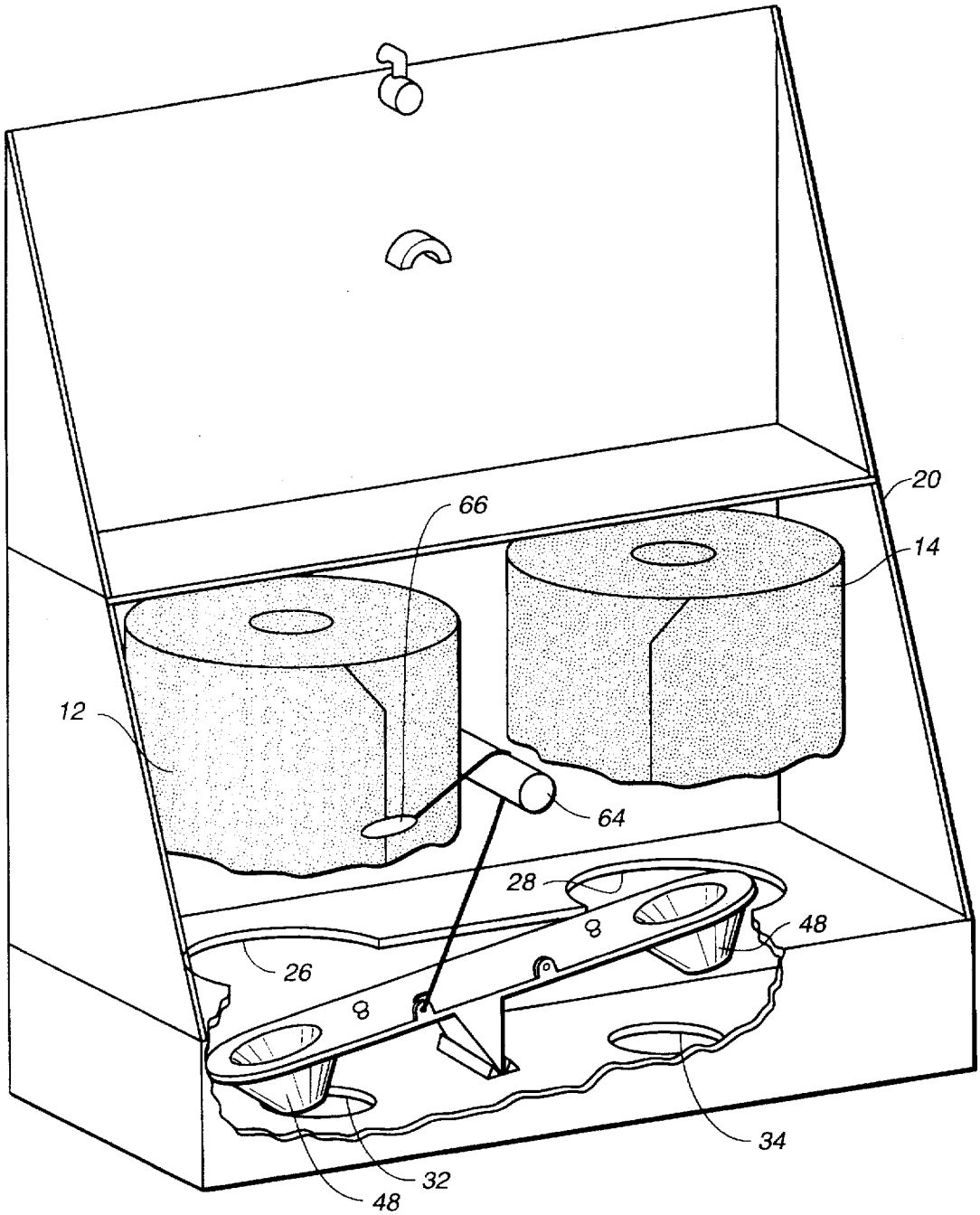
FIG. 1B is a perspective view of the housing in open condition and showing two center pull coreless rolls in position in the housing interior.

Referring now to FIGS. 1–3, apparatus constructed in accordance with the teachings of the present invention is illustrated. The dispenser apparatus is for sequentially dispensing sheet material from two center pull coreless rolls of sheet material disposed side-by-side. The illustrated rolls are center pull coreless paper towel rolls identified by reference numerals 12, 14. Each roll includes a lead end 16 and a tail end 18. The lead end 16 of each towel projects downwardly from the coreless center of the roll and in effect comprises an extension of the innermost: roll convolution. The paper towel roll construction just described is well known, it being appreciated that dispensing of the toweling proceeds from the center outwardly until depletion of the roll at the tail end thereof.

The rolls 12, 14 are disposed within the interior of a housing 20. More particularly, the rolls 12, 14 are disposed side-by-side. A support plate 24 is connected to the housing and extends into the housing interior to support the rolls 12, 14 at respective first and second locations on the support plate. Defined by the support plate at those locations are spaced openings 26, 28 through which the lead ends of the rolls project.

Located under support plate 24 and spaced therefrom is housing bottom 30 defining spaced outlet openings 32, 34.

Pivotally supported by the central segment of housing bottom 30 is dispenser element support means in the form of a pivotally movable dispenser element support member 40 having opposed ends and a downwardly projecting pivot member 42 positioned in a notch 44 formed in housing bottom 30.

Supported at the opposed ends of the dispenser element support member 40 are dispenser elements in the form of nozzles 48, 50, each having a truncated cone-like configuration and defining a passageway diminishing in size in a downward direction for receiving the lead end of one of the rolls. More particularly, nozzle 48 receives the lead end from roll 12 and nozzle 50 receives the lead end from roll 14. The nozzle 48 is located below opening 26 of the support plate and above outlet opening 32 in the housing bottom. Nozzle 50 is located below opening 28 in the support plate and above outlet opening 34 in the housing bottom.

Figure 2A:
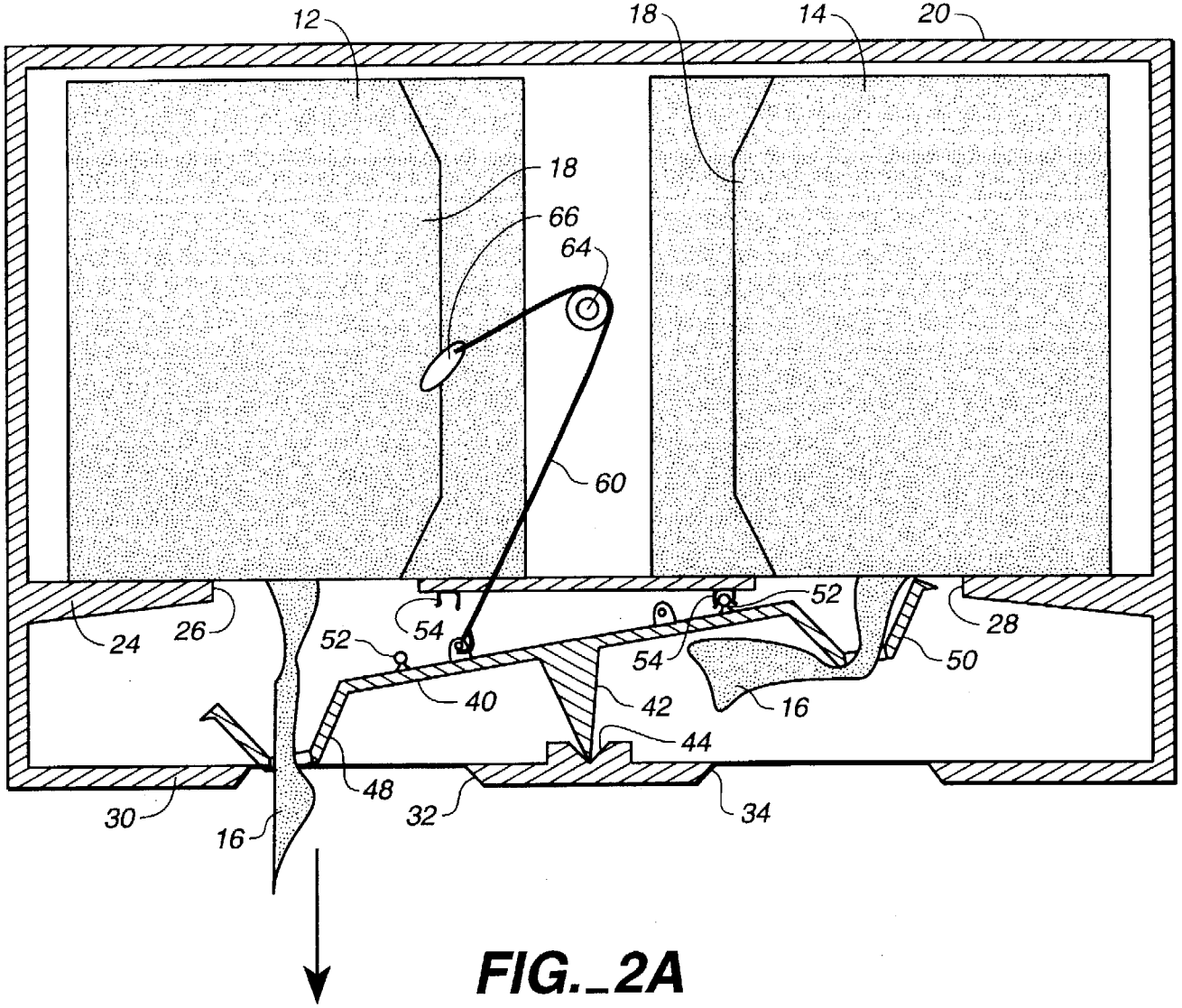
FIGS. 2A–2D are cross-sectional views of the dispenser illustrating the positions assumed by structural components thereof at different stages of operation.

FIG. 2A shows the relative positions of the structural elements of the dispenser apparatus when the two rolls are in the housing interior and dispensing of toweling is from roll 12 through nozzle 48. In this situation the nozzle 48 is at a lower position and nozzle 50 is at an upper position. That is, the dispenser element support member 40 is tilted downwardly toward the left as viewed in FIG. 2A.

Dispensing from roll 12 is accomplished by an individual grasping the lead end 16 of that roll and pulling same to move the toweling downwardly through the nozzle 48 and outlet opening 32. The operation of truncated cone-like dispensing nozzles per se and the cooperation thereof during the dispensing process with paper toweling is well known and will not be described. Suffice it to say that pulling of the lead end by the consumer will eventually result in the tearing off of a length of the toweling and leave the resulting new lead end projecting from the nozzle for subsequent manual grasping.

Nozzle 50 has the lead end 16 of roll 14 projecting therethrough, roll 14 serving the function of a reserve roll which will automatically become accessible to a user upon depletion of roll 12, the latter referred to as the primary roll. The lead end 16 from roll 14 is maintained above and away from the housing bottom 30 and outlet opening 34 secured in notch 70 so that it cannot be readily accessed until roll 12 is depleted. In the arrangement illustrated, two detents 52 project upwardLy from dispenser element support member 40 at spaced locations thereon. Projecting downwardly from the central portion of support plate 24 are resilient clips 54 for receiving the detents. In FIG. 2A the detent 52 located at the end of dispenser element support member 40 corresponding to nozzle 50 is releasably retained in its associated clip. This will serve to retain nozzle 50 in its raised or upward, non-dispensing position and nozzle 48 in its lower, dispensing position.

Connected to dispenser element support member 40 is an elongated flexible cord 60 which passes over and about cord support 64. The distal upper end of the cord 60 is connected by any suitable means to the tail end 18 of roll 12. Such means may, for example, comprise a clamp member 66 clampingly engaging the tail end.

Figure 2B:
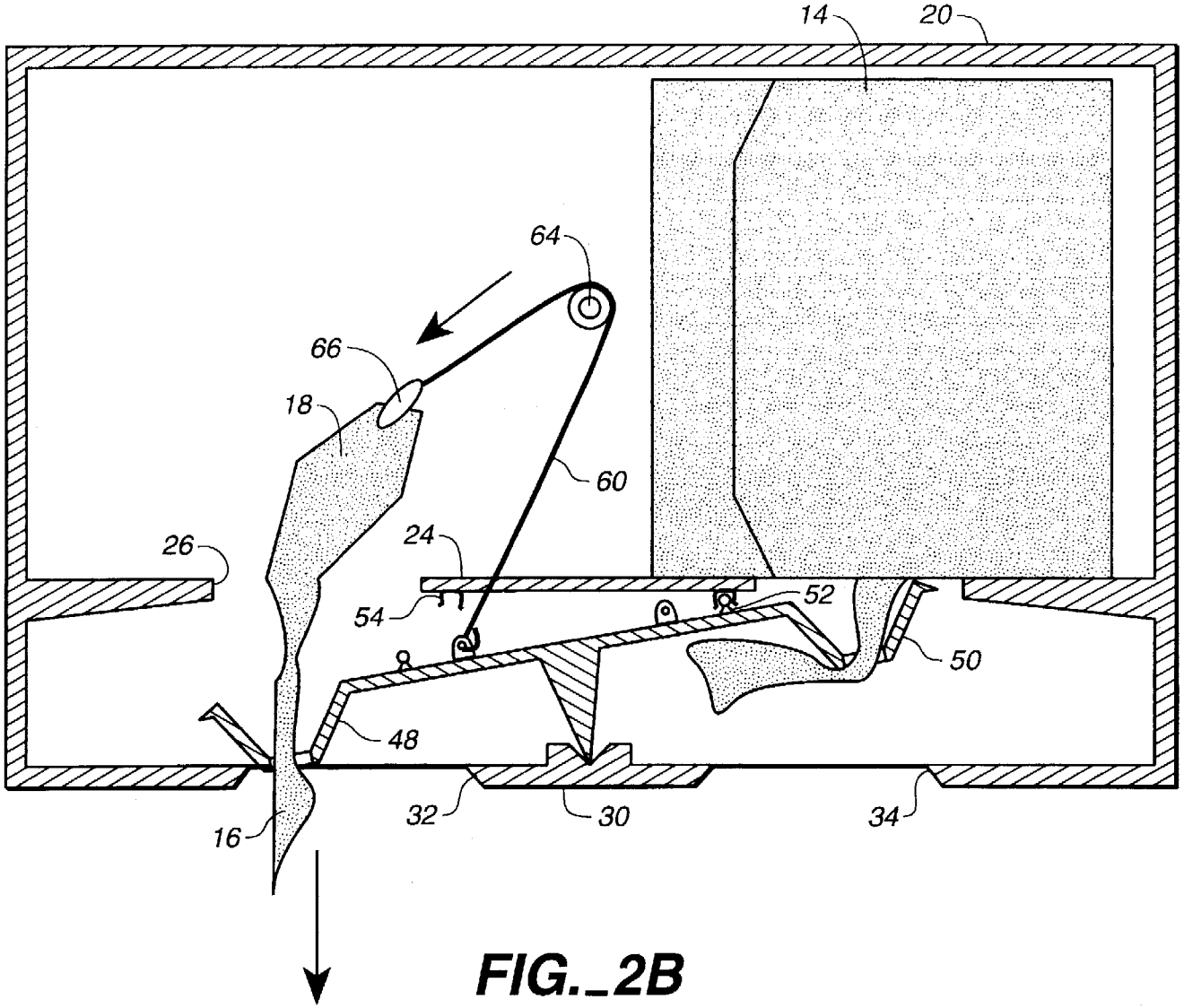

Referring now to FIG. 2B, roll 12 has been virtually depleted and the tail end thereof is shown being pulled downwardly by downward movement of the lead end 16. This results in a pulling force being exerted on cord 60 which, in turn, causes an upwardly directed pulling force to be exerted on dispenser element support member 40 at the end thereof associated with nozzle 48.

Figure 2C:
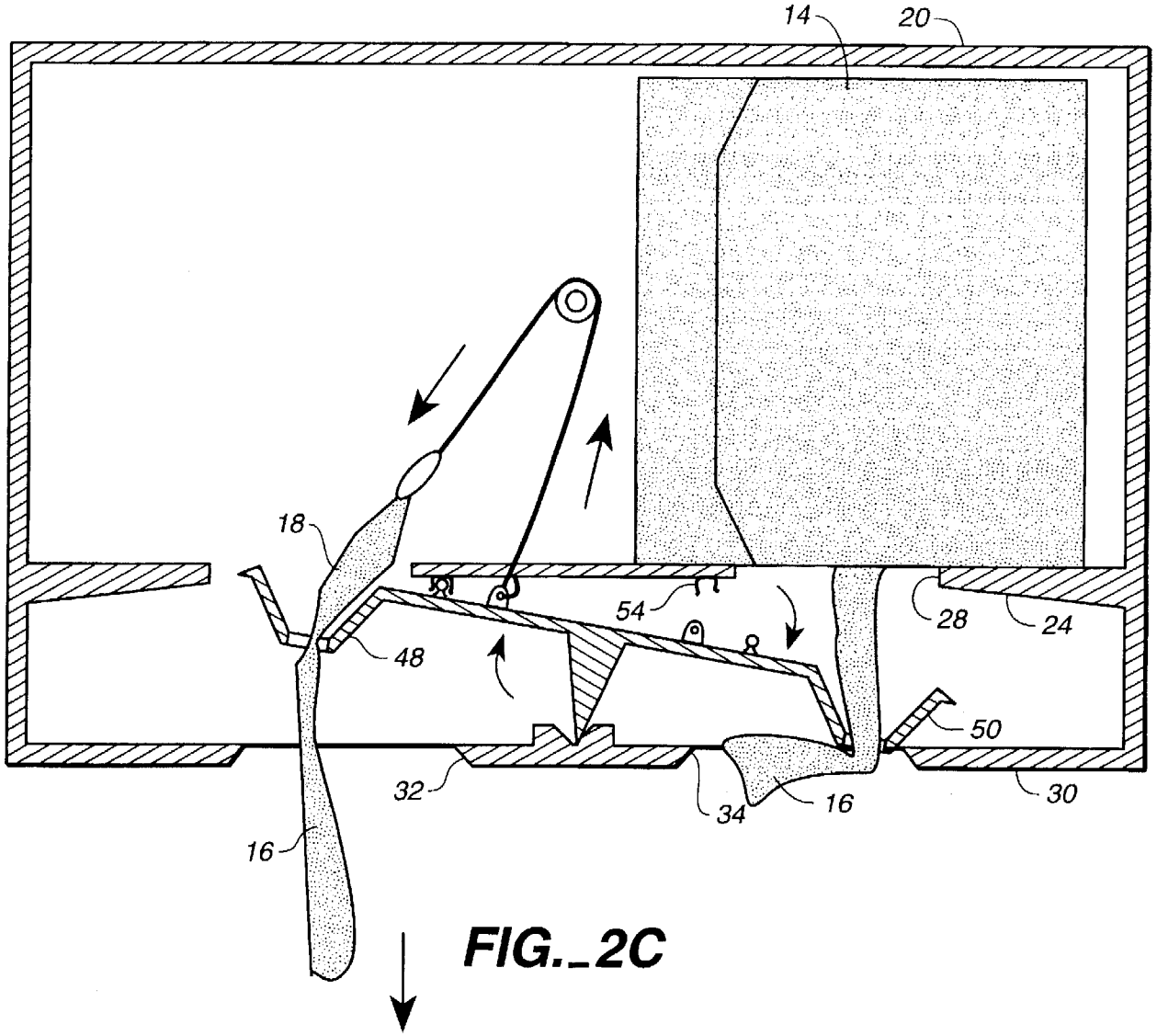

Continued pulling of the lead end will cause the dispenser element support member 40 to be pivoted in a clockwise direction as viewed in FIG. 2C and as indicated by the curved arrows. This movement will cause nozzle 48 to move upwardly away from housing bottom 30 and simultaneously bring nozzle 50 downward toward and closely adjacent to the housing bottom. Thus, the lead end 16 of roll 14 will now be in its dispensing position for ready manual access at outlet opening 34 of the housing bottom.

Roll 14 is now the primary or dispensing roll from which dispensing takes place.

Figure 2D:
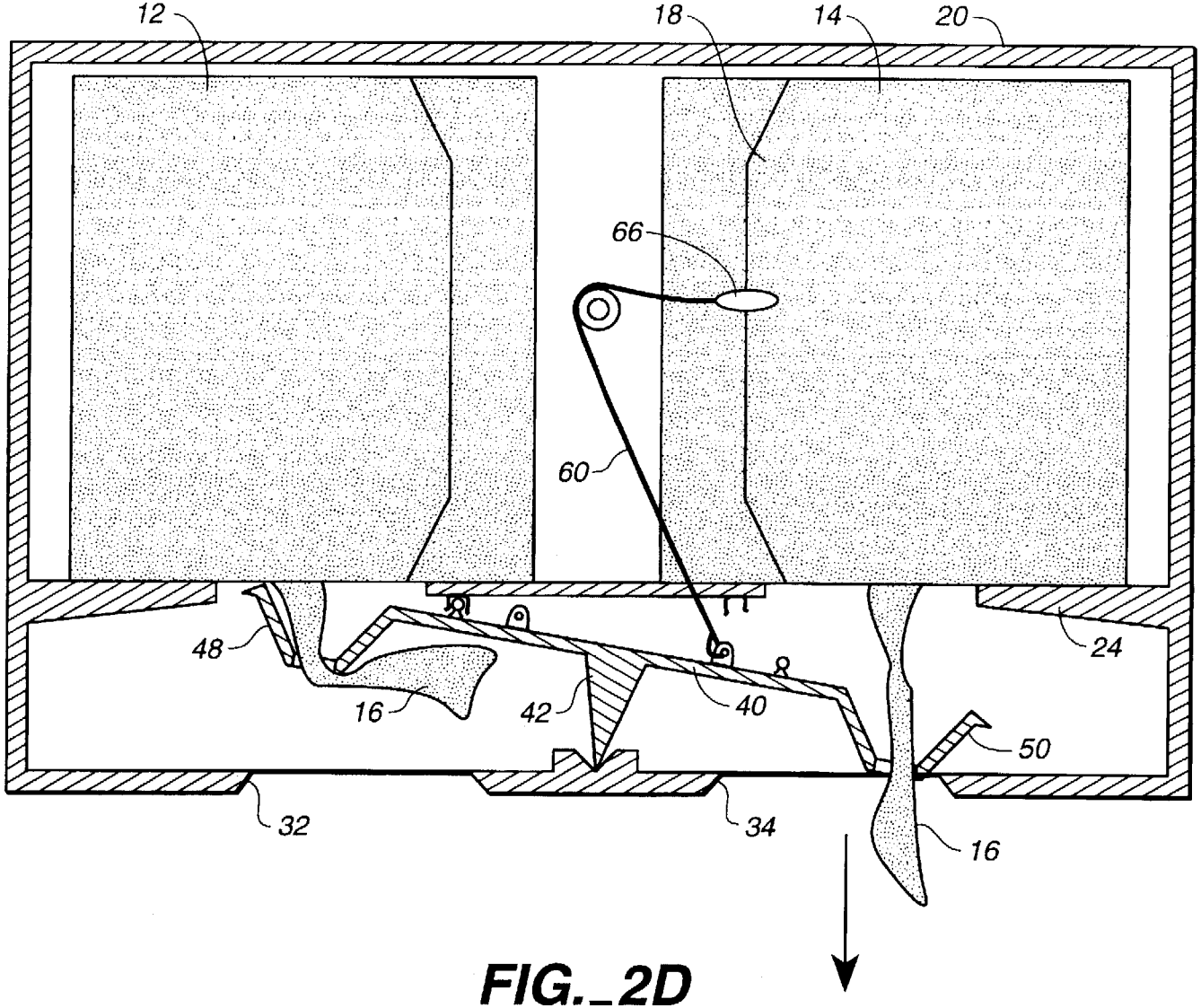

Sometime before depletion of roll 14, the dispenser apparatus will be serviced to replace the depleted roll 12 with a new roll 12 which will function as the reserve roll. FIG. 2D shows a new reserve roll 12 in position as the reserve roll, the lead end 16 thereof passing through and projecting from the raised nozzle 48. The attendant has also attached clamp member 66 to the tail end 18 of roll 14 and connected the lower end of the cord 60 to the dispenser element support member 40 at a location between the pivot member 42 and the nozzle 50. Upon depletion of roll 14 the nozzle 50 will be raised and the nozzle 48 lowered to present the lead end 16 of the replacement roll 12 for manual access.

FIG. 3 is an enlarged, top plan view illustrating nozzle 50 and an associated segment of dispenser element support member 40. The passageway defined by the nozzle diminishes as it progresses downwardly to the exit opening 68 of the nozzle. A lead end retention notch 70 is formed in the nozzle at the exit opening or lower end thereof which communicates with the nozzle passageway.

After the lead end of a new roll of paper toweling is fed through the nozzle, the lead end is manually wedged into the notch by the attendant to hold the lead end to the side as shown in FIGS. 2A and 2B so that the lead end is not readily manually accessed by a consumer until the nozzle 50 drops into dispensing position as previously described. Once however the nozzle 50 has dropped, the consumer can manually access the lead end through opening 34 and pull the lead end out of the retaining notch and pull the toweling downwardly through the nozzle. The nozzle 48 has a similar construction.

Figure 5:
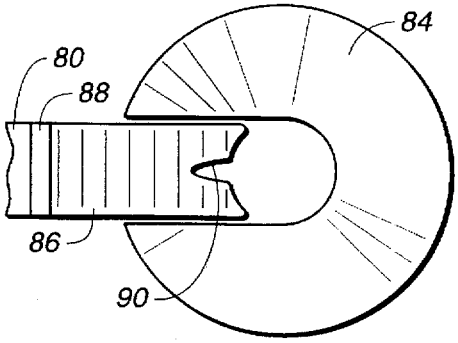
FIG. 5 is an enlarged detail view of a dispenser element of the second embodiment and a portion of related structure.
Figure 4A:
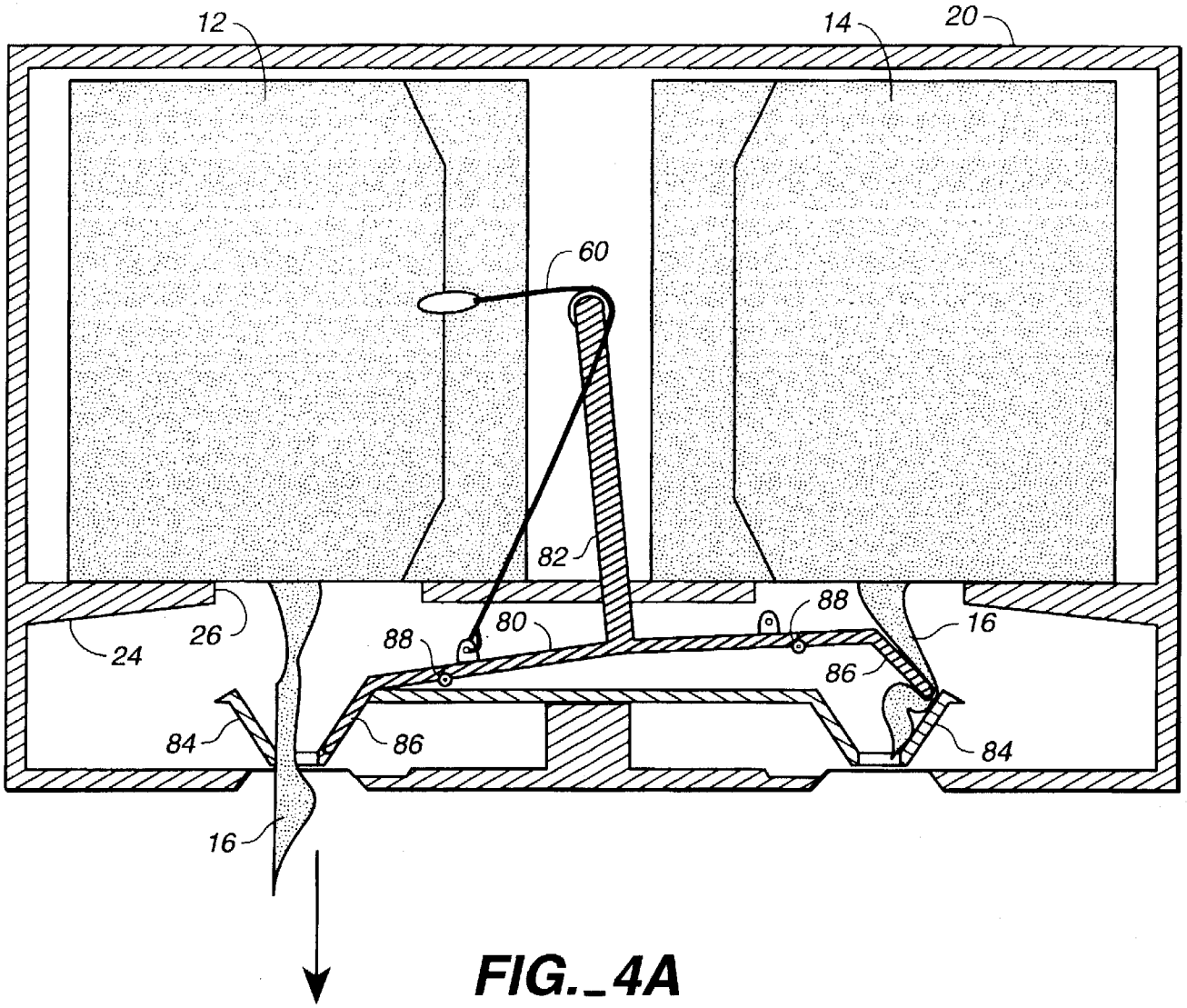
FIGS. 4A and 4B are cross-sectional views of a second embodiment of the dispenser apparatus illustrating the positions assumed by structural components thereof at different stages of operation.
Figure 4B:
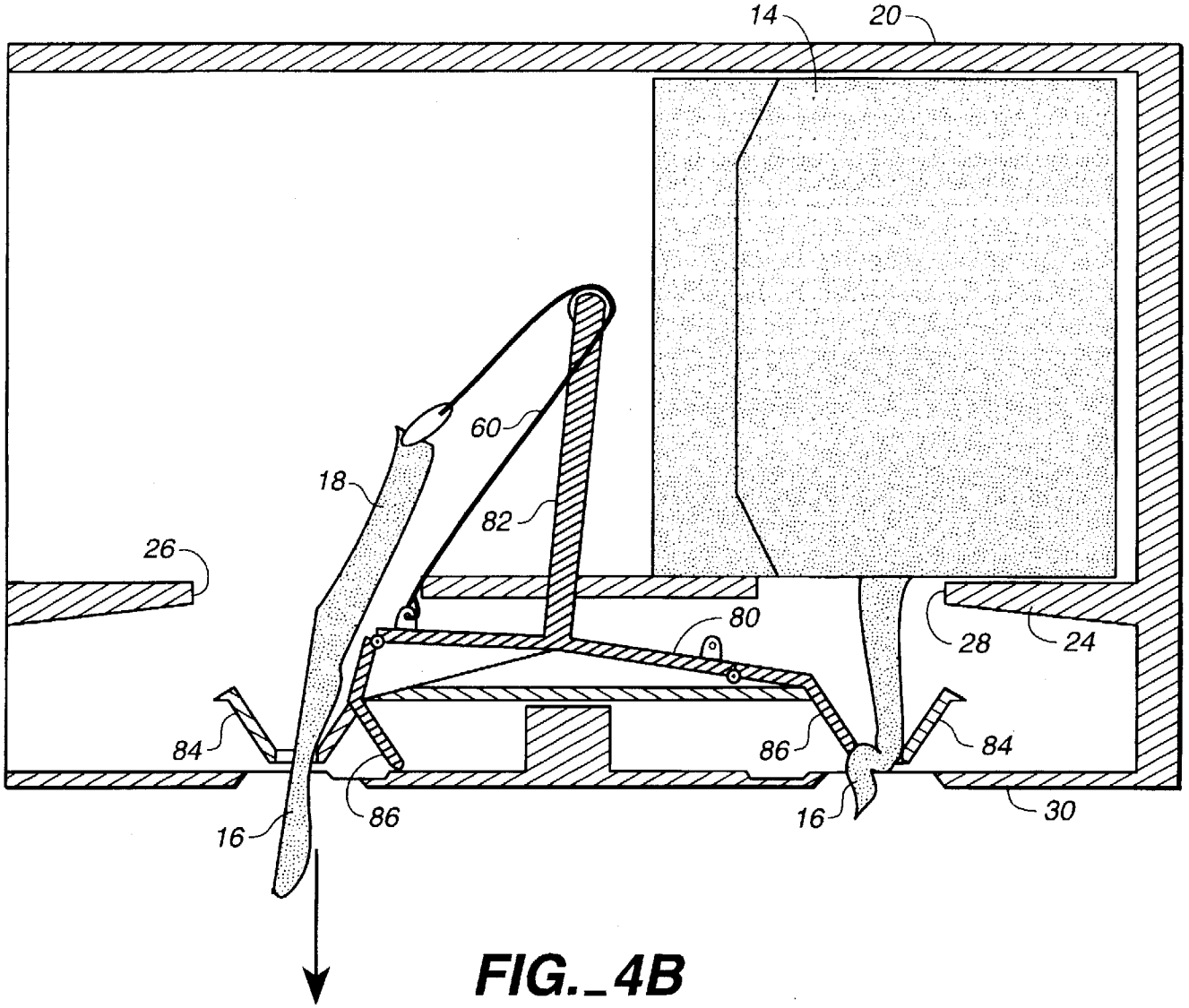

Referring now to FIGS. 4A, 4B and 5, an alternative arrangement of dispenser apparatus is illustrated. In this alternate embodiment the dispenser element support member 80 does not have a downwardly extending pivot member. Instead, the dispenser element support member 80 includes an upwardly extending elongated structural member 82 which is pivotally connected to the housing 20 at the upper end thereof. In the arrangement illustrated, the cord 60 passes about a cord support positioned at the location of pivotal attachment between the structural member 82 and the housing.

In this arrangement the dispenser nozzles each include a stationary dispenser element or nozzle portion 84 maintained at a fixed location over the housing outlet openings and a movable nozzle portion 86 which is hingedly connected to the support member 80 at hinges 88. A lead end retention notch 90 (see FIG. 5) is defined by the movable nozzle portion at the distal end thereof.

In FIG. 4A the stationary and movable nozzle portions of the nozzle shown at the left are together and form a completed truncated cone-like nozzle, movable nozzle portion 86 having been lowered to dispensing position. Thus, dispensing from roll 12 can occur as illustrated by the arrow in FIG. 4A.

On the other hand, the nozzle shown in FIG. 4A at the right side of the dispenser apparatus has the movable nozzle portion 86 thereof in raised condition along with the lead end 16 of roll 14.

FIG. 4B shows the condition of the apparatus components when roll 12 is at depletion stage. Cord 60 has served to pivot the support member 80 so that the movable nozzle portion 86 of the left nozzle has been pulled upwardly thereby and the movable nozzle portion 86 of the right nozzle has been lowered toward the housing bottom to present the lead end 16 of roll 14 for dispensing purposes. In the arrangement illustrated, the hinged connection between the movable nozzle portions and support member 80 allows the movable nozzle portions to swing inwardly so that they will not interfere with passage of the primary roll tail end at the time of transfer to the reserve roll.

I claim:

1. Dispenser apparatus for sequentially dispensing sheet material from two center pull coreless rolls of sheet material disposed side-by-side, each coreless roll of sheet material including a lead end and a tail end, said dispenser apparatus comprising, in combination:

support means for supporting a first coreless roll of sheet material on end at a first location and for supporting a second coreless roll of sheet material on end at a second location with said first and second coreless rolls of sheet material disposed side-by-side;

a first dispenser element located adjacent to said support means and defining a passageway for receiving the lead end of a first coreless roll of sheet material supported on end by said support means at said first location; and a second dispenser element located adjacent to said support means and defining a passageway for receiving the lead end of a second coreless roll of sheet material supported on end by said support means at said second location, said second dispenser element being movably mounted relative to said support means and movable away from said support means to a dispensing position wherein the lead end of said second coreless roll of sheet material is presented for manual grasping by an individual and pulling of sheet material by the individual from said second coreless roll of sheet material through the passageway of said second dispenser element.

2. The dispenser apparatus according to claim 1 additionally comprising dispenser element moving means for moving said second dispenser element to dispensing position responsive to depletion of said first coreless roll of sheet material.

3. The dispenser apparatus according to claim 2 wherein said dispenser element moving means includes a movable dispenser element support member connected to said second dispenser element for imparting movement to said second dispenser element upon pivoting of said movable dispenser element support member.

4. The dispenser apparatus according to claim 3 wherein said dispenser element moving means includes attachment means for attaching said movable dispenser element support member to the tail end of the first coreless roll of sheet material supported by said support means.

5. The dispenser apparatus according to claim 4 wherein said attachment means includes an elongated flexible element extending between and connected to the tail end of said first coreless roll of sheet material and said movable dispenser element support member.

6. The dispenser apparatus according to claim 1 wherein both said first dispenser element and said second dispenser element are movably mounted relative to said support means and movable away from said support means to dispensing position.

7. The dispenser apparatus according to claim 6 additionally comprising dispenser element support means connected to said first and second dispenser elements for imparting substantially simultaneous movement to said first and second dispenser elements, with one of said dispenser elements moving away from said support means to dispensing position while the other of said dispenser elements substantially simultaneously moves away from dispensing position and toward said support means.

8. The dispenser apparatus according to claim 7 wherein said dispenser element support means comprises a pivotally movable dispenser element support member having opposed ends, said first dispenser element attached to said pivotally movable dispenser element support member at one of said ends and said second dispenser element attached to said pivotally movable dispenser element support member at the other of said ends.

9. The dispenser apparatus according to claim 1 wherein said dispenser elements have truncated cone-like configurations.

10. The dispenser apparatus according to claim 1 additionally comprising a housing defining a housing interior and including a housing bottom with a housing outlet opening formed therein communicating with said housing interior, said second dispenser element being located closely adjacent to said housing outlet opening when in dispensing position.

11. The dispenser apparatus according to claim 1 wherein said second dispenser element defines a coreless roll lead end retention notch communicating with the passageway thereof.

12. The dispenser apparatus according to claim 1 including retention means operatively associated with said second dispenser element for preventing movement of said second dispenser element to dispensing position until a pulling force of predetermined magnitude is applied to said second dispenser element.

13. Dispenser apparatus for sequentially dispensing sheet material from two center pull coreless rolls of sheet material disposed side-by-side, each coreless roll of sheet material including a lead end and a tail end, said dispenser apparatus comprising, in combination:

support means for supporting a first coreless roll of sheet material at a first location on said support means and for supporting a second coreless roll of sheet material at a second location on said support means with said first and second coreless rolls of sheet material disposed side-by-side, said support means defining at least one support means opening for allowing passage of the lead ends of said coreless rolls of sheet material therethrough;

a first dispenser element located under said support means and defining a passageway for receiving the lead end of a first coreless roll of sheet material supported by said support means;

a second dispenser element located under said support means and defining a passageway for receiving the lead end of a second coreless roll of sheet material supported by said support means;

a housing defining a housing interior accommodating said support means and said dispenser elements and having a housing bottom disposed below said support means, said dispenser elements being positioned between said housing bottom and said support means; and means responsive to depletion of a coreless roll of sheet material supported by said support means to substantially simultaneously move one of said dispenser elements away from said housing bottom and one of said dispenser elements toward said housing bottom.

14. Dispenser apparatus for sequentially dispensing sheet material from two center pull coreless rolls of sheet material disposed side-by-side, each coreless roll of sheet material including a lead end and a tail end, said dispenser apparatus comprising, in combination:

support means for supporting a first coreless roll of sheet material at a first location on said support means and for supporting a second coreless roll of sheet material at a second location on said support means with said first and second coreless rolls of sheet material disposed side-by-side, said support means defining at least one support means opening for allowing passage of the lead ends of said coreless rolls of sheet material therethrough;

a first dispenser element located under said support means and defining a passageway for receiving the lead end of a first coreless roll of sheet material supported by said support means, said first dispenser element having at least a portion thereof movable between an upper, non-dispensing position and a lower, dispensing position;

a second dispenser element located under said support means and defining a passageway for receiving the lead end of a second coreless roll of sheet material supported by said support means, said second dispenser element having at least a portion thereof movable between an upper, non-dispensing position and a lower, dispensing position; and means responsive to depletion of a coreless roll of sheet material supported by said support means to substantially simultaneously move at least a portion of one of said dispenser elements from upper, non-dispensing position to lower, dispensing position and at least a portion of the other of said dispenser elements from lower, dispensing position to upper, non-dispensing position.

15. The dispenser apparatus according to claim 14 additionally comprising a housing including a housing bottom having at least one outlet opening, said housing defining a housing interior accommodating said support means and said dispenser elements, said dispenser element portions when in their respective lower, dispensing positions being closer to said housing bottom and to said at least one outlet opening than when in their respective upper, non-dispensing positions.

16. The dispenser apparatus according to claim 15 wherein each of said dispenser elements comprises a nozzle having a truncated cone-like configuration and wherein said portions comprise segments of said nozzles.

* * * * *